US011838707B2

(12) United States Patent
Vilermo et al.

(10) Patent No.: US 11,838,707 B2
(45) **Date of Patent: *Dec. 5, 2023**

(54) CAPTURING SOUND

(71) Applicant: Nokia Technologies Oy, Espoo (FI)

(72) Inventors: Miikka Vilermo, Siuro (FI); Mikko-Ville Laitinen, Helsinki (FI); Koray Ozcan, Farnborough (GB)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 17/392,338

(22) Filed: Aug. 3, 2021

(65) Prior Publication Data

US 2021/0368248 A1 Nov. 25, 2021

Related U.S. Application Data

(63) Continuation of application No. 15/742,611, filed as application No. PCT/FI2016/050493 on Jul. 5, 2016, now Pat. No. 11,115,739.

(30) Foreign Application Priority Data

Jul. 8, 2015 (GB) ..... 1511949
Jul. 27, 2015 (GB) ..... 1513198

(51) Int. Cl.
*H04R 1/00* (2006.01)
*H04S 7/00* (2006.01)
(Continued)

(52) U.S. Cl.
CPC ..... *H04R 1/005* (2013.01); *H04R 1/406* (2013.01); *H04R 3/005* (2013.01); *H04R 5/027* (2013.01);
(Continued)

(58) Field of Classification Search
CPC . H04R 1/24; H04R 1/26; H04R 1/323; H04R 1/40; H04R 1/44; H04R 2225/53; H04R 2430/23; H04R 25/602; H04R 3/02; H04R 3/12; H04R 5/033; H04R 1/08; H04R 1/1075; H04R 1/2819; H04R 1/2834; H04R 1/2842; H04R 1/2857; H04R 25/356; H04R 25/456; H04R 25/48; H04R 25/55;
(Continued)

(56) References Cited

U.S. PATENT DOCUMENTS 6,198,693 B1 3/2001 Marash ..... 342/417
7,587,054 B2 * 9/2009 Elko ..... H04R 5/027 381/92
(Continued)

FOREIGN PATENT DOCUMENTS

EP 1377041 A2 1/2004
EP 2840807 A1 2/2015
(Continued)

*Primary Examiner* — Lun-See Lao
(74) *Attorney, Agent, or Firm* — Harrington & Smith

(57) ABSTRACT

An apparatus including a body, a plurality of microphones arranged in a predetermined geometry relative to the body such that the apparatus is configured to capture sound substantially from all directions around the body to produce direction and ambience information for the captured sound, and electronics for processing signals from the plurality of microphones.

20 Claims, 6 Drawing Sheets

(51) Int. Cl.
*H04R 1/40* (2006.01)
*H04R 3/00* (2006.01)
*H04R 5/027* (2006.01)

(52) U.S. Cl.
CPC ..... *H04S 7/30* (2013.01); *H04R 2201/401* (2013.01); *H04S 2400/15* (2013.01); *H04S 2420/01* (2013.01)

(58) Field of Classification Search
CPC .... H04R 25/60; H04R 25/607; H04R 25/609; H04R 25/65; H04R 25/656; H04R 25/658; H04R 7/06; H04R 7/08; H04R 7/12; H04R 7/22; H04R 7/26; H04R 9/025; H04R 9/027; H04R 9/046; G10K 11/17823; G10K 11/17854; G10K 11/17855; G10K 11/17857; G10K 11/17881; G10K 11/20; G10K 11/24; G10K 11/34; G10K 11/346; G10K 11/348; G10K 11/352; G10K 11/355; G10K 13/00; G10K 15/12; G10K 2210/3027; G10K 2210/3042; G10L 19/008; G10L 2021/02166; G10L 15/24; G10L 19/012; G10L 19/018; G10L 19/02; G10L 19/0204; G10L 19/035; G10L 2021/02165; G10L 21/02; G10L 21/0208; G10L 21/034; G10L 21/10; G10L 25/72; G10L 25/78
USPC ..... 381/92; 700/94
See application file for complete search history.

(56) References Cited

U.S. PATENT DOCUMENTS

| | | | | |
|---|---|---|---|---|
| 9,055,371 | B2 | 6/2015 | Tammi | |
| 9,319,785 | B2 | 4/2016 | Lee | |
| 2009/0190775 | A1* | 7/2009 | Reining | H04R 1/406 381/92 |
| 2011/0222372 | A1 | 9/2011 | O'Donovan et al. | 367/103 |
| 2013/0147835 | A1 | 6/2013 | Lee et al. | 345/629 |
| 2013/0202114 | A1 | 8/2013 | Tammi et al. | |
| 2013/0230187 | A1* | 9/2013 | Kuech | H04R 3/005 381/92 |
| 2014/0270245 | A1 | 9/2014 | Elko | 381/92 |
| 2015/0003634 | A1 | 1/2015 | Yliaho | 381/103 |
| 2015/0030159 | A1 | 1/2015 | Ozcan | 381/17 |
| 2016/0219365 | A1 | 7/2016 | Elko | |
| 2018/0199137 | A1 | 7/2018 | Mate | |

FOREIGN PATENT DOCUMENTS

| | | |
|---|---|---|
| WO | WO-2010/125228 | 11/2010 |
| WO | WO-2014/114364 A1 | 7/2014 |
| WO | WO-2015/076149 A1 | 5/2015 |

* cited by examiner

CAPTURING SOUND

RELATED APPLICATION

This application is a continuation of U.S. patent application Ser. No. 15/742,611, filed Jan. 8, 2018, which is a National Stage Entry of Patent Cooperation Treaty Application No. PCT/FI2016/050493, filed Jul. 5, 2016, which claims priority to International Application No. GB 1511949.8, filed Jul. 8, 2015 and International Application No. GB 1513198.0, filed Jul. 27, 2015. Each of these applications are hereby incorporated by reference in their entirety.

FIELD

The present application relates to capturing of sound for spatial processing of audio signals to enable spatial reproduction of audio signals.

BACKGROUND

Spatial audio comprises capturing and processing audio signals in order to provide the perception of audio content based on directional information and ambient information of a sound field. Spatial processing may be implemented within applications such as spatial sound reproduction. The aim of spatial sound reproduction is to reproduce the perception of spatial aspects of a sound field. These include the direction, the distance, and the size of the sound source, as well as properties of the surrounding physical space.

However, capturing of sound for spatial processing and subsequent reproduction poses certain problems. For example, some sound of interest may not be captured at all, or is captured in non-natural way. Sound capturing devices may need a human operator to point them towards sound content of interest. Handling (e.g. turning) of the device, by a human operator or otherwise, may cause undesired interference signal. The operator may also cause acoustic shadowing.

The herein described examples aim to address at least some of these concerns.

SUMMARY

In accordance with an aspect there is provided an apparatus comprising a body, a plurality of microphones arranged in a predetermined geometry relative to the body such that the apparatus is configured to capture sound substantially from all directions around the body to produce direction and ambience information for the captured sound, and electronics for processing signals from the plurality of microphones.

In accordance with another aspect there is provided a method for capturing sound, comprising capturing sound by a plurality of microphones located in a predetermined geometry relative to a body of a capture apparatus substantially from all directions around the body, and producing direction and ambience information for the captured sound.

In accordance with a more detailed aspect the microphones are arranged such that a predefined minimum number of microphones is visible from any direction. At least eight microphones may be arranged such that sound from any direction is captured by at least four of the microphones.

A plurality of second type of sensors may be provided. The second type of sensors may comprise cameras and/or motion sensors. The geometry and/or number of microphones forming the geometry depends on location and/or number of the second type of sensors.

The body may have a substantially spherical outer shape.

The microphones may be arranged symmetrically around the body.

The microphones may be arranged in identical manner relative to the body such that sound is captured in the same manner by each microphone. The microphones may also be arranged in identical manner relative to the electronics such that sound signals from each microphone is subjected to a similar disturbance caused by other components and/or delays within the apparatus.

The microphones may be arranged such that, in use, no directing of the body is required.

A protruding element extending from the body at a location where the element and/or use of the element causes least interference for the sound capture. The protruding element can be provided for controlling the direction of the body and/or handling the apparatus and/or indicating a preferred direction.

The electronics may be configured to produce predetermined number of sound channels for reproduction based on signals from the microphones. All electronics required to generate at least one signal for a reproduction device may be included in the body of the apparatus. Alternatively, at least a part of electronics required to generate at least one signal for a reproduction device is external to the body of the apparatus.

In one embodiment, the predetermined geometry is formed by at least eight microphones. The predetermined geometry may be substantially a cube geometry with each microphone located at a corner of the cube geometry. The output signals of the eight microphones may be processed to determine a directional information of at least one sound source in a sound field. The output signals of the eight microphones may be processed to determine an ambient information of a sound field.

A computer program product stored on a medium may cause an apparatus to perform the method as described herein.

A chipset providing at least a part of the processing as described herein may also be provided.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective sound capture for spatial signal processing. The herein described examples relate to the field of audio presence capture by an apparatus comprising a multiple of microphones. In accordance with certain examples spatial audio field around an apparatus with microphones is captured in all directions, or at least substantially in all directions, around the device to produce presence capture of a sound field. The capture can be provided, in addition to around the device on a horizontal plane, all directions above and below. That is, the capture can be provided along all three axis of a coordinate system. Microphones can be placed according to a predetermined geometry on the apparatus so that it is possible to record audio from all directions and so that the auditory shadowing effect of the body of the apparatus is minimized.

In example embodiments, the plurality of microphones is forming substantially a cube geometry or a cube like geometry. Each microphone is located at a corner of the geometry where three surfaces of the cube or cube like geometry meet. In other example embodiments, other geometry shapes can be formed by the location of the plurality of microphones. It is understood that the apparatus contains the geometry by the plurality of microphones.

The plurality of microphones can be arranged outside or inside the apparatus in a geometric configuration. The configuration can be a pre-determined configuration so as to capture a presence of sound field from all directions. The microphones can be arranged symmetrically so that microphones capture the audio regardless the direction the sound is coming from. The microphones may be placed symmetrically so that at least some microphone pairs are provided that have a symmetrical shadowing effect and auditory delays from the body. The symmetric positioning assists in preserving good quality audio by making processing the audio signals easier, and providing, at least in some directions, each ear a similar sounding audio.

Figure 1:
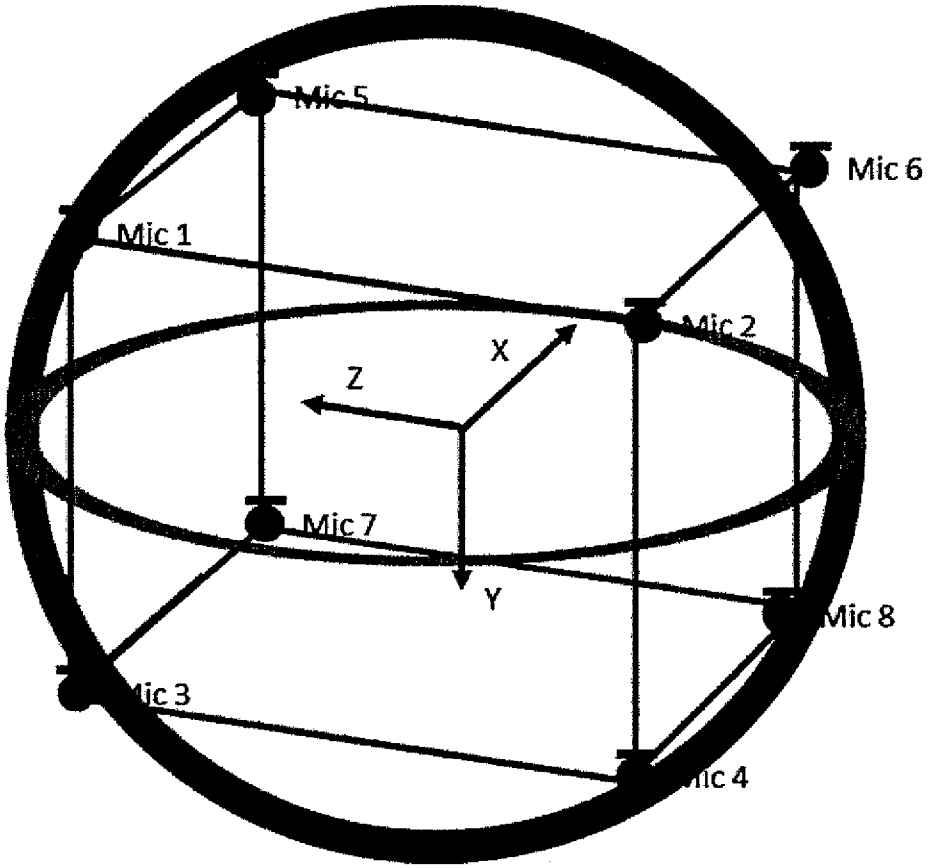
FIG. 1 shows schematically an audio capture apparatus according to some embodiments.

FIG. 1 illustrates a schematic presentation of an apparatus comprising a pre-determined geometric configuration for the plurality of microphones as disclosed herein. More particularly, FIG. 1 shows a possible arrangement of eight positioned in the corners of a cuboid. In this way there are microphones with only a small shadowing effect from the body in all directions around the body of the apparatus. It shall be understood that such pre-determined geometric configuration can be contained inside any shape of a portable electronic device.

The geometry of microphone locations can be arranged such that at least the same minimum number of microphones is always visible from any direction. For example, the arrangement can be such that an identical pattern of microphones is visible in x, y and z axis direction.

Figure 2:
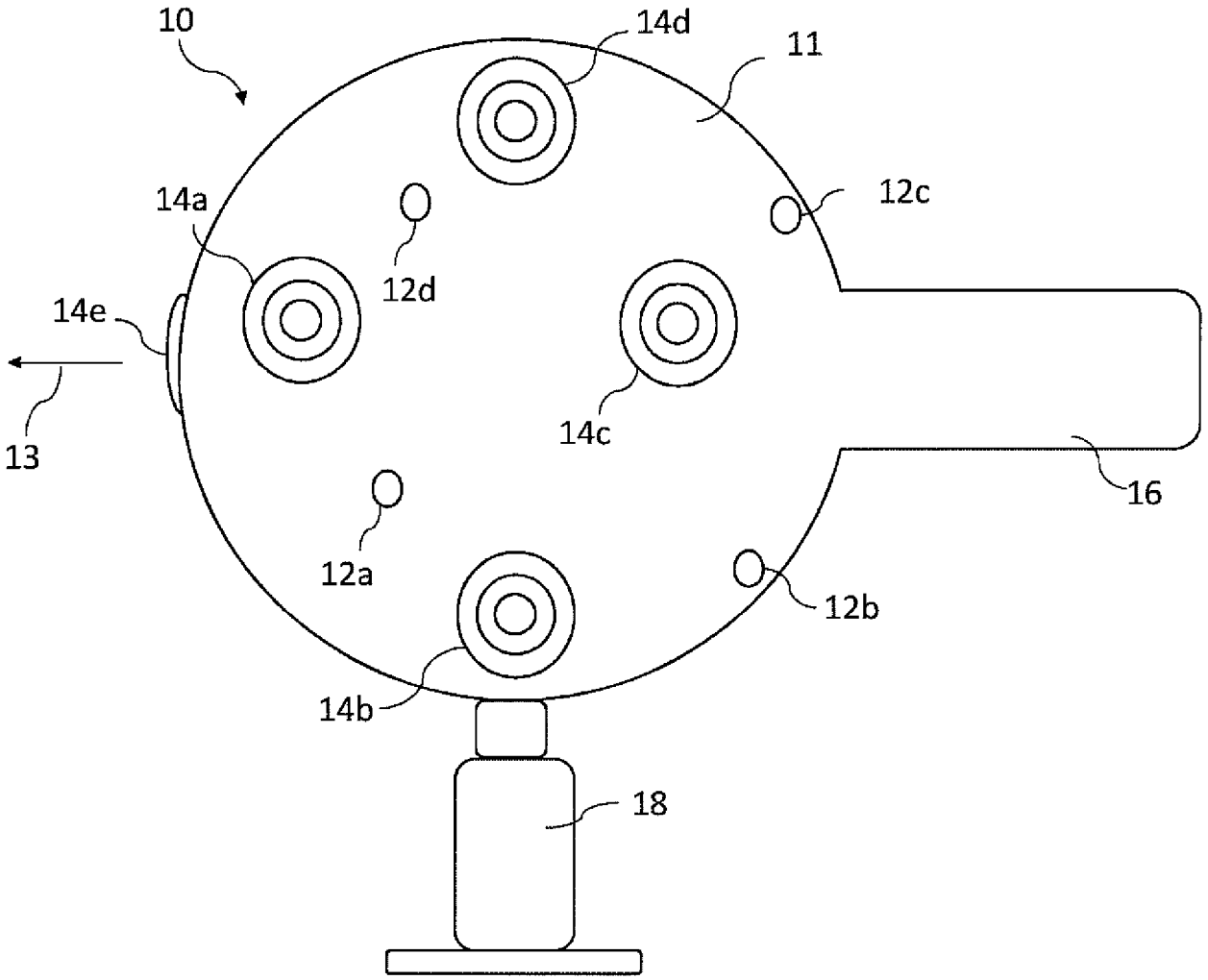
FIGS. 2 and 3 show a more detailed example of an audio and video capture device from two directions.
Figure 3:
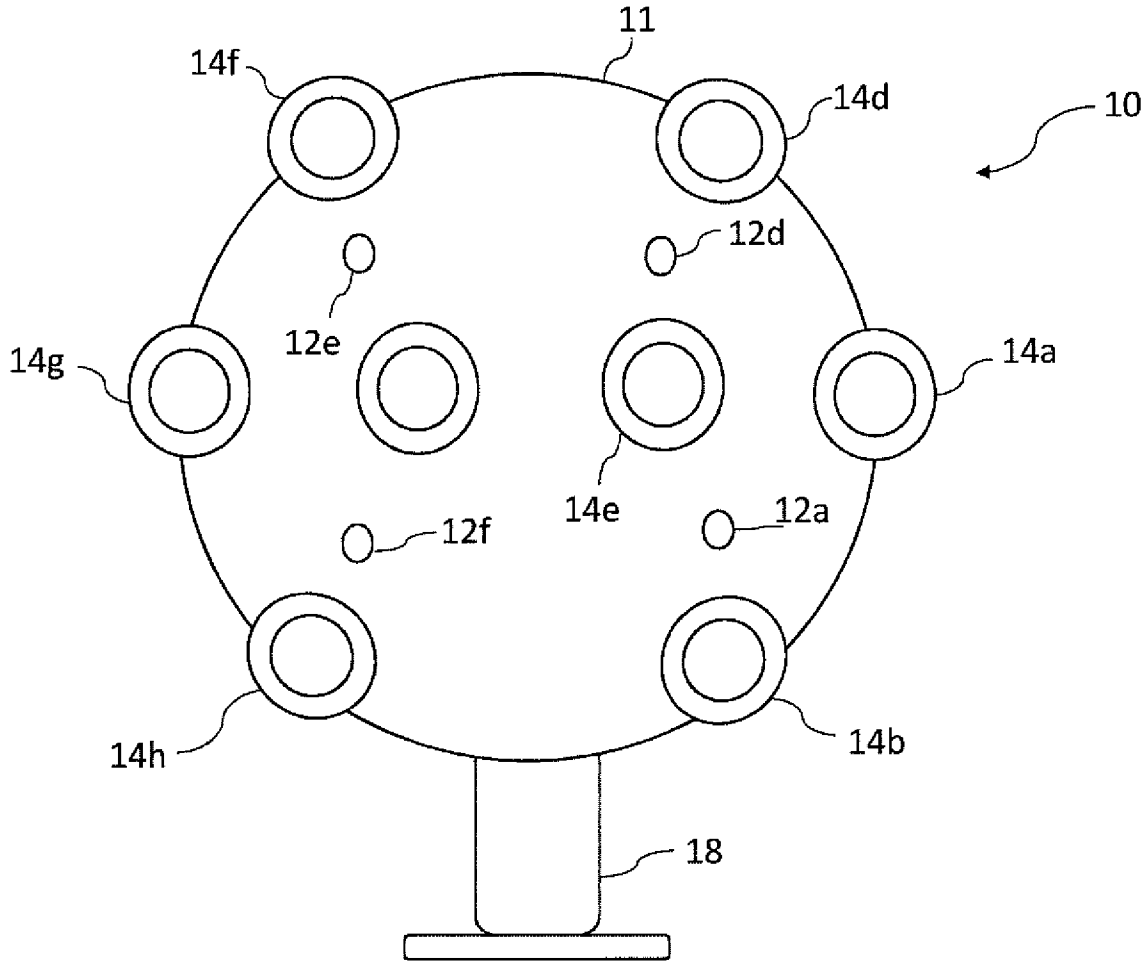

In the examples of FIGS. 1 to 3 four microphone locations out of eight possible locations can be easily seen from any location. Four visible microphones is believed to give good performance with a minimum number of microphones capturing the sound from a direction in producing direction and ambient information about the sound.

In the context of the term microphone, what is a visible part of a microphone and what part of a microphone captures the sound it is noted that the visible parts referred to herein are not necessarily the physical microphone components but a viewer could see only sound outlets for each microphone from each viewing angle (right-left-top-bottom-front-behind). Such outlets, for example holes on the body, can be only acoustically coupled to respective microphone components. Nevertheless, in the context of this disclosure these parts shall be understood to be covered by the general term microphone. Thus in this specification the term microphone is used throughout to refer to any part of a physical microphone arrangement providing a part of the geometrical arrangement of microphones by which sound can be captured from substantially all around the body of the apparatus.

According to a possibility the body has a substantially spherical shape. In FIG. 1 the ball like shape of the body is illustrated with the two circles to indicate an approximately spherical shape.

In certain embodiments, the shape can be designed to have a suitably shaped extension, for example in the form of a holder, for handling of the apparatus. The extension can be designed so as to avoid interfering, in use, with the plurality of microphones, and the plurality of camera modules, if provided.

The microphones can have separation in all directions (x, y, z) to be able to capture all directions. This may require capture by a minimum of four microphones. The microphone may need to be positioned such that they are not on the same plane.

A smaller or larger minimum number of microphones may be used for the capture. For example, less than four microphone, such as three microphones, can be sufficient if only directions on horizontal plane are desired. In this case the microphones would typically be on a (virtual) horizontal plane placed around the body of the apparatus.

Microphone pairs may also be provided such that multiple pairs of microphones can be used to estimate sound directions from a plurality of directions around the device. Statistical analysis can be used to merge the multiple pair direction estimates into one. Information on ambience sounds can also be produced. Alternatively, all eight microphones can be used for capturing the sound field. It is understood that a directional information of a sound source in a sound field and an ambience information of the sound field can be determined by using all eight microphones.

In some example embodiments, the plurality of microphones are arranged in a geometrical shape in such a way that sound outlet/s of at least 4 microphones can be visually seen from a viewing direction whilst other microphones are shadowed in the same viewing direction. In alternative embodiments, other arrangements can be provided so that 2 of the plurality of microphones can be substantially shadowed from substantially all viewing directions. It is understood that this kind of positional microphone arrangement provides particular benefits in capturing and reproduction. For example, at least some or all non-shadowed microphones can be used for the mid signal determination (and generation) whereas at least some or all shadowed microphones are used for the side signal determination (and generation).

The apparatus can also be adapted to capture video at the same time. The video capture can also be substantially around all directions. The positioning and/or number of microphones can be dependent on the positioning and/or number of cameras. The device can thus be configured to capture both audio and video information from all directions in order to capture an enhanced presence of visual and sound fields.

The position of the microphones, and cameras if these are provided, makes possible to record audio, and the possible video, substantially from all directions. The configuration can be such that the apparatus does not need to be rotated or otherwise moved when interesting audio, and possible video, content moves around the device.

In addition to a plurality of camera modules, the plurality of microphones may also be arranged relative to a plurality of second type of sensors. For example, motion sensors may be provided.

Various aspects of the spatial sound field can be captured. For example, the directional part of the sound field, the direction of the sound field and/or the ambient part of the sound field can be captured. The captured information can be stored, at least temporarily, and used in dependence of the circumstances of the listener, for example based on viewing direction and/or position of the listener. Examples for this will be explained in more detail later in this description.

The apparatus can be designed and dimensioned so that it is portable. The portable presence capture device can have microphones all around the device to be able to capture audio from all directions with minimal shadowing effects by the device. Although the apparatus is classified as portable, it can be positioned or fixed at a location. The apparatus can be interfaced with another mechanical part.

The apparatus can have a preferred direction. Means for directing the apparatus by a user may also be provided.

An example of an audio capturing device 10 configured according to the herein disclosed principles is shown in FIGS. 2 and 3 from two directions. The device 10 is shown to have roughly a spherically shaped body 11. However, other shapes may also be used. The body of the device may be, for example, about 10-30 cm in diameter. However, this range is just an example, and other sizes, even sizes of a totally different magnitude are also possible.

The device is provided with a plurality of microphones, FIGS. 2 and 3 showing microphones 12*a*-12*f*. In total, device 10 has eight microphones placed symmetrically around the body thereof. The microphones may be omnidirectional or directional (such as cardioids). Preferably, if directional microphones are used, or if omni-microphones are in places where the device body makes the microphone response directional at least in some frequency bands, the directions of the directional microphones can be arranged to approximately cover all directions around the device.

A plurality of cameras 14*a*-14*h* is also provided. Device 10 has eight cameras capable of capturing video image and covering the entire surrounding of the device. It is noted that a different number of cameras may be used, depending on the application.

A possible arrangement of the microphones relative to the body and the cameras can be seen from the side and end views of FIGS. 2 and 3.

The device can have a preferred viewpoint. In FIG. 2 this is indicated by arrow 13. The preferred viewpoint may be one where the device works best and/or where playback of files or stream captured by the device is started when the captured multimedia is viewed using e.g. a mobile device, head mounted display, computer screen, virtual reality environment with many displays and so on. The preferred viewpoint may be indicated by the shape of the device. For example, a protruding element may be provided in the shape of the otherwise mostly symmetric device to point towards or away from the preferred viewpoint. In FIG. 2 this is provided by a protruding element 16 extending from the otherwise spherical body. The element 16 also provide handle for a user to direct and/or move the device around. The preferred direction may also be indicated by an appropriate marking on the device. In this way the user intuitively knows the preferred orientation of the device.

As shown, the microphones are symmetrically placed on the body to help produce symmetric shadowing by the device body for good sounding audio (at least in some viewing directions). Alternatively, at least some subsets of microphones are symmetrically placed. Symmetric arrangement can be provided by pairs of microphones or by all microphones. Symmetric placements may also help in creating signals where the delays from different sound sources around the device are symmetric. This can make analysis of the sound source directions easier, and also can make the signals reproduced accurately by producing symmetric signals to both ears. This can be provided at least in certain viewing directions.

The device may contain its own power source, processor(s), memory, wireless networking capability etc. In some cases the device may be connected to a power supply and cable network. FIGS. 2 and 3 show also a stand 18. This can be of any shape and design, for example a tripod, a pivoted arm, a rotatable arm and so forth. It is also possible to have a capturing device with no stand.

The microphones can be arranged in various directions. Below are certain examples where the center of the device is considered to provide the origin (see FIG. 1) and where zero degrees for both azimuth and elevation is the preferred viewpoint direction. In the tables below left column is the azimuth and the right column is the elevation in degrees.

Example 1

| | |
|---|---|
| 45 | −35.2644; |
| 135 | −35.2644; |
| −135 | −35.2644; |
| −45 | −35.2644; |
| 45 | 35.2644; |
| 135 | 35.2644; |
| −135 | 35.2644; |
| −45 | 35.2644. |

Example 2

| | |
|---|---|
| 0 | −35.2644; |
| 90 | −35.2644; |
| 180 | −35.2644; |
| 270 | −35.2644; |
| 0 | 35.2644; |
| 90 | 35.2644; |
| 180 | 35.2644; |
| 270 | 35.2644 |

Example 3

| | |
|---|---|
| 45 | −33.2644; |
| 135 | −33.2644; |
| −135 | −332644; |
| −45 | −33.2644; |
| 45 | 33.2644; |
| 135 | 33.2644; |
| −135 | 33.2644; |
| −45 | 33.2644. |

The wires from the device microphones to the processor(s) may be symmetric so that any disturbance caused by the device electronics is similar in all microphone signals. This can be provide advantage in processing the microphone signals because the differences between them are caused more by the relative positions of the microphones to the sound sources than the device electronics. The microphone inlets and device shape around the inlets may be similar.

This helps in processing the microphone signals because the differences between them are caused more by the relative positions of the microphones to the sound sources than the shape of the inlets and the shape of the device.

It is possible to estimate a multitude of directions so that one direction is estimated from a subset of the microphones and there is a plurality of subsets. A single final direction estimate is the estimated from the multitude of directions using statistic processing (e.g. mean or median direction).

Microphones may be placed relative to a multiple of cameras so that each camera in the device has a subset of microphones positioned similarly around it. This can be advantageous for example in a case where viewpoints are used directly instead of using video processing to create viewpoints in between the cameras. When viewpoints are used in this way and the microphones are placed similarly with respect to each camera, the audio properties are similar regardless of which camera is being used.

In some embodiments, the microphones are located in such a way that when a sound source is substantially located on-axis (along either x, y, z, −x, −y or −z axis, see FIG. 1) from the electronic device, the electronic device is able to substantially point at least four microphones (and accordingly microphone outlet's for respective microphones) towards the direction of the sound source. The microphones can be arranged in a substantially symmetrical configuration in view of each axis direction, FIG. 1 showing an example of such configuration. For example, there can be four pairs of microphones (Mic1, Mic2), (Mic3, Mic4), (Mic5, Mic6) and (Mic7, Mic9) that all point to z-axis direction. This enables easy beamforming towards z (and −z) axis directions. Also, this configuration can be advantageously used for estimating sound source direction using the time differences when the sound arrives in each microphone.

Assuming, for example, that the sound source is somewhere near z-axis direction of FIG. 1. There are four microphones (Mics 1, 3, 5, 7) that receive sound from that source without significant acoustic shadowing by the device body (Mics 2, 4, 6, 8 receive the sound in an acoustic shadow). For detecting how much the sound source direction differs from z-axis in +−x-axis direction it is possible to use two microphone pairs (Mic1, Mic5) and (Mic3, Mic7) that receive the sound source without shadowing and with clear time difference. For detecting how much the sound source direction differs from z-axis in +−y-axis direction it is possible to use two microphone pairs (Mic1, Mic3) and (Mic5, Mic7) that receive the sound source without shadowing and with clear time difference. These multitude of direction estimates can then be combined using statistical methods (e.g. mean, median and so on). This configuration allows similarly a multitude of pairs towards all on-axis directions, and thus this configuration can be better than any that would have some microphones missing or microphones in a significantly different configuration.

The device can capture many aspects of the spatial sound field. For example: the directional part of the sound field, the direction of a sound source in the sound field and the ambient part of the sound field. The directional part can be captured using beamforming or for example methods presented in GB patent application 1511949.8. The GB application discloses certain examples how it is possible to generate at least one mid signal configured to represent the audio source information and at least two side signals configured to represent the ambient audio information. The captured component can be stored and/or processed separately. Acoustical shadowing effect may be exploited with respect to certain embodiments to improve the audio quality by offering improved spatial source separation for sounds originating from different directions and employing multiple microphones around the acoustically shadowing object. The mid signal can be created using adaptively selected subsets of available microphones and the multiple side signals using multiple microphones. The mid signal can be created adaptively based on an estimated direction of arrival (DOA). Furthermore the microphone 'nearest' or 'nearer' to the estimated DOA may be selected as a 'reference' microphone. The other selected microphone audio signals can then be time aligned with the audio signal from the 'reference' audio signal. The time-aligned microphone signals may then be summed to form the mid signal. It is also possible that the selected microphone audio signals are weighted based on the estimated DOA to avoid discontinuities when changing from one microphone subset to another. The side signals may be created by using two or more microphones for creating the multiple side signals. To generate each side signal the microphone audio signals can be weighted with an adaptive time-frequency-dependent gain. These weighted audio signals may be convolved with a predetermined decorrelator or filter configure to decorrelate the audio signals. The generation of the multiple audio signals may further comprise passing the audio signal through a suitable presentation or reproduction related filter. For example the audio signals may be passed through a head related transfer function (HRTF) filter where earphones or earpiece reproduction is expected or a multi-channel loudspeaker transfer function filter where loudspeaker presentation is expected.

All or a subset of the microphones can be used for capturing the directional part. The number of microphones and which microphones are used may depend on the characteristics of the sound e.g. on the direction of the sound. The direction of the sound may be estimated for example using multilateration that is based on the time differences when a sound from a sound source arrives at different microphones. The time differences may be estimated using correlation. All or a subset of the microphones can be used for estimating the direction of the sound sources. The direction may be estimated separately for short time segments (typically 20 ms) and for many frequency bands (for example third octave bands, Bark bands or similar).

The number of microphones and which microphones are used may depend on the characteristics of the sound. For example, one might first make an initial estimate using all microphones and then make a more reliable estimate using the microphones that are on the same side of the device as the initial estimated source direction was. Another example method can be found in US publication 2012/0128174.

The ambience can be estimated using all or a subset of microphones. If the same ambience signal is used for all directions for a user viewing the captured content, then typically all microphones or the microphones that are not used for capturing the directional content are used for creating the ambience. Alternatively, if a more accurate ambience is desired, microphones in the substantially opposite direction of the user viewing direction can be used to create the ambience. Alternatively, in some embodiments, microphones substantially opposite to the sound source direction are used to create the ambience signal.

All the methods can work based on a frequency band segmentation, time segmentation and directional segmentation so that the directional signal, directional information and ambience signal are different in each combination of segments.

Methods presented in GB patent application 1511949.8 may be used to capture the sound and convert it to 5.1, 7.1, binaural or other formats. Audio captured by the device may be stored, transmitted and/or streamed as such or converted to some other audio representation. The audio may also be compressed using existing or future audio codecs such as mp3, MPEG AAC, Dolby AC-3, MPEG SAOC, etc. The audio data can be in the form of direct microphone signals thus leaving the rendering into a suitable reproduction method (stereo speakers, 5.1 speakers, more complex speaker setups with "height speakers", headphones etc.), the audio data can be in the form of already made 5.1, 7.1 signals etc., the audio data can be in the form multiple parallel signals (e.g. binaural signals), one signal for each direction so that the directions (typically 5-32 directions) are distributed around a sphere, the audio data can be in the form of one or more directional signals+directional information+one or more ambient signals (this form again leaves rendering to a suitable reproductions method such as 5.1, binaural etc. to be done at the device that receives the "directional+directional information+ambient representation"; GB patent application 1511949.8, and US publications 2012/0128174 and 2013/0044884 give examples how this can be done).

The captured audio data may also be reproduced by a device with build in speakers or through headphones (possibly as a binaural signal) or by a mobile phone, tablet, laptop, PC etc. A possibility for reproducing the data captured by the herein described apparatus is by a head mounted display with headphones so that the user viewing and listening to the data can turn his head and experience all directions in audio, and also in video, if this capability is provided. The produced information of the captured sound can be advantageously used in augmented reality applications.

A listener/viewer may even be provided with real time stream of video and audio. With a head tracking device the video and audio can track the real life situation.

A mechanical or wireless connector may also be provided so as to enable an interface mechanism.

The device can be freely rotated and positioned in any direction as desired. The design can comprise a holder and/or a base parts but in other example embodiments such holder and/or base parts may not be required. The size of a portable capturing device can have any dimensions, for example, the length, width and height can be designed at around 15-30 cm for a symmetrical shape portable design. The total length, height, width dimensions may be enlarged due to the holder or handling parts as mentioned above. The size of the portable device can be influenced by the number of mentioned plurality of microphones and/or camera modules. The size of the portable device can also be influenced by the pre-determined geometric microphone configuration.

An audio capture device may comprise various additional features, such as an internal battery or connectivity for an external battery, an internal charger or connectivity for an external charger, one or more suitable connectors such as micro USB, AV jack, memory card, HDMI, DisplayPort, DVI, RCA, XLR, 3.5 mm plug, ¼" plug etc., one or more processors including DSP algorithms etc., internal memory, wired and/or wireless connectivity modules such as LAN, BT, WLAN, infrared etc., cameras, display such as LCD, speakers, and other sensors such as GPS, accelerometers, touch sensors and so on.

A presence capture device can be provided where audio and its direction is recorded from all directions around the device. Orientation of the device does not need to be changed, e.g. the device does not need to be rotated when sound sources (and visual sources) of interest move around the device because the device records all directions simultaneously. Microphone locations enable using statistical analysis for improving sound direction analysis. Symmetrical device shape and microphone locations and similar inlets and wiring all contribute to microphone signals that are easier to analyze and sound better. Unlike in the prior art where devices cannot capture sound and video from all directions, thus missing some potentially interesting content, the device can be arranged to capture all sound in its surrounding. Since the device does not need to be turned during capture, handling the device that could cause handling noise and can require a user near the device causing added acoustic shadowing effect can be avoided. The device is easy to use. The user does not necessary need to have a professional sound technician level understanding of spatial sound processing. Instead, the user can position the device, and accordingly the configured geometry of the microphones so that the device electronics can process the required information for accurate spatial audio capturing and reproduction of the captured sound.

Figure 4:
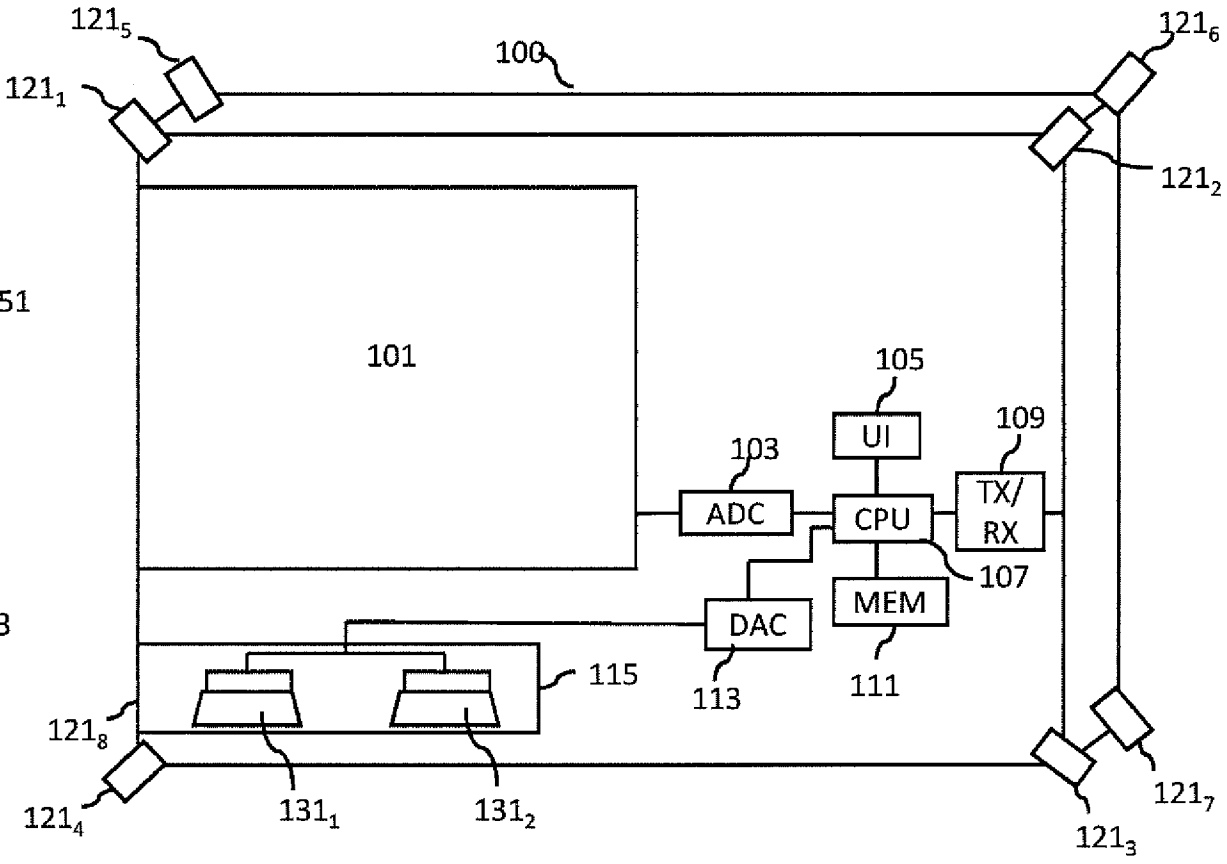
FIG. 4 shows schematically a view of components of an apparatus according to some embodiments.

FIG. 4 shows an example for internal components of audio capture apparatus suitable for implementing some embodiments. The audio capture apparatus 100 comprises a microphone array 101. The microphone array 101 comprises a plurality (for example a number N) of microphones. The example shown in FIG. 4 shows the microphone array 101 comprising eight microphones 1211 to 1218 organised in a hexahedron configuration. In some embodiments the microphones may be organised such that they are located at the corners of an audio capture device casing such that the user of the audio capture apparatus 100 may use and/or hold the apparatus without covering or blocking any of the microphones.

The microphones 121 are shown configured to convert acoustic waves into suitable electrical audio signals. In some embodiments the microphones 121 are capable of capturing audio signals and each outputting a suitable digital signal. In some other embodiments the microphones or array of microphones 121 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones 121 can in some embodiments output the audio captured signal to an analogue-to-digital converter (ADC) 103.

The audio capture apparatus 100 may further comprise an analogue-to-digital converter 103. The analogue-to-digital converter 103 may be configured to receive the audio signals from each of the microphones 121 in the microphone array 101 and convert them into a format suitable for processing. In some embodiments the microphones 121 may comprise an ASIC where such-analogue-to-digital conversions may take place in each microphone. The analogue-to-digital converter 103 can be any suitable analogue-to-digital conversion or processing means. The analogue-to-digital converter 103 may be configured to output the digital representations of the audio signals to a processor 107 or to a memory 111.

The audio capture apparatus 100 electronics can also comprise at least one processor or central processing unit 107. The processor 107 can be configured to execute various program codes. The implemented program codes can comprise, for example, spatial processing, mid signal generation, side signal generation, time-to-frequency domain audio signal conversion, frequency-to-time domain audio signal conversions and other algorithmic routines.

The audio capture apparatus can further comprise a memory 111. The at least one processor 107 can be coupled to the memory 111. The memory 111 can be any suitable storage means. The memory 111 can comprise a program code section for storing program codes implementable upon the processor 107. Furthermore, the memory 111 can further comprise a stored data section for storing data, for example data that has been processed or to be processed. The implemented program code stored within the program code section and the data stored within the stored data section can be retrieved by the processor 107 whenever needed via the memory-processor coupling.

The audio capture apparatus can also comprise a user interface 105. The user interlace 105 can be coupled in some embodiments to the processor 107. In some embodiments the processor 107 can control the operation of the user interface 105 and receive inputs from the user interface 105. In some embodiments the user interface 105 can enable a user to input commands to the audio capture apparatus 100, for example via a keypad. In some embodiments the user interface 105 can enable the user to obtain information from the apparatus 100. For example, the user interface 105 may comprise a display configured to display information from the apparatus 100 to the user. The user interface 105 can in some embodiments comprise a touch screen or touch interface capable of both enabling information to be entered to the apparatus 100 and further displaying information to the user of the apparatus 100.

In some implements the audio capture apparatus 100 comprises a transceiver 109. The transceiver 109 in such embodiments can be coupled to the processor 107 and configured to enable a communication with other apparatus or electronic devices, for example via a wireless or fixed line communications network. The transceiver 109 or any suitable transceiver or transmitter and/or receiver means can in some embodiments be configured to communicate with other electronic devices or apparatus via a wireless or wired coupling.

The transceiver 109 can communicate with further apparatus by any suitable known communications protocol. For example in some embodiments the transceiver 109 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The audio capture apparatus 100 may also comprise a digital-to-analogue converter 113. The digital-to-analogue converter 113 may be coupled to the processor 107 and/or memory 111 and be configured to convert digital representations of audio signals (such as from the processor 107) to a suitable analogue format suitable for presentation via an audio subsystem output. The digital-to-analogue converter (DAC) 113 or signal processing means can in some embodiments be any suitable DAC technology.

Furthermore the audio subsystem can comprise in some embodiments an audio subsystem output 115. An example as shown in FIG. 4 is a pair of speakers $\mathbf{131}_1$ and $\mathbf{131}_2$. The speakers 131 can in some embodiments be configured to receive the output from the digital-to-analogue converter 113 and present the analogue audio signal to the user. In some embodiments the speakers 131 can be representative of a headset, for example a set of earphones, or cordless earphones.

Furthermore the audio capture apparatus 100 is shown operating within an environment or audio scene wherein there are multiple audio sources present. In the example shown in FIG. 4 the environment comprises a first audio source 151, a vocal source such as a person talking at a first location. Furthermore the environment shown in FIG. 4 comprises a second audio source 153, an instrumental source such as a trumpet playing, at a second location. The first and second locations for the first and second audio sources 151 and 153 respectively may be different. Furthermore in some embodiments the first and second audio sources may generate audio signals with different spectral characteristics.

Although the audio capture apparatus 100 is shown having both audio capture and audio presentation components, it would be understood that the apparatus 100 can comprise just the audio capture elements such that only the microphones (for audio capture) are present. Similarly in the following examples the audio capture apparatus 100 is described being suitable to performing the spatial audio signal processing described hereafter. The audio capture components and the spatial signal processing components may also be separate. In other words the audio signals may be captured by a first apparatus comprising the microphone array and a suitable transmitter. The audio signals may then be received and processed in a manner as described herein in a second apparatus comprising a receiver and processor and memory.

Figure 5:
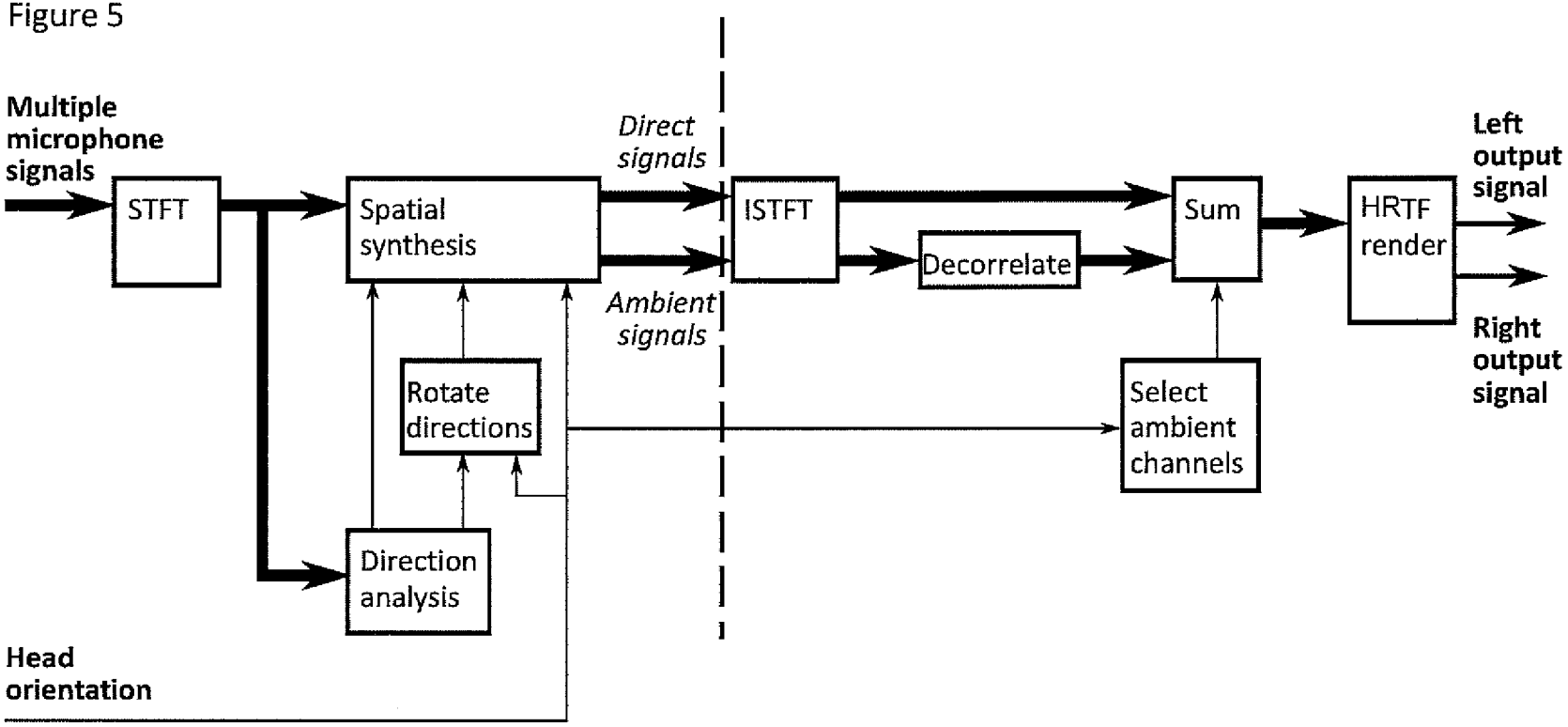
FIG. 5 shoes a block diagram in accordance with an embodiment.

FIG. 5 is a schematic block diagram illustrating processing of signals from multiple microphones to output signals on two channels. Other multi-channel reproductions are also possible. In addition to input from the microphones, input regarding head orientation can be used by the spatial synthesis.

For the sound processing and reproduction, the components can be arranged in various different manners.

According to a possibility everything left of the dashed line takes place in the presence capture device, and everything right of the Direct/Ambient signals takes place in a viewing/listening device, for example a head mounted display with headphones, a tablet, mobile phone, laptop and so on. The direct signals, ambient signals and directional information can be coded/stored/streamed/transmitted to the viewing device.

According to a possibility all processing takes place in the presence capture device. The presence capture device can comprise a display and a headphone connector (e.g. a ¼" plug) for viewing the captured media. The direct signals, ambient signals and directional information are coded/stored in the presence capture device.

According to a possibility all processing takes place in the presence capture device but instead of one output (Left output signal, Right output signal) there is one output for many directions, e.g. 32 outputs for different directions that the user viewing the media can look into. The user viewing the media has preferably a head mounted device with headphones which switches between the output signals 32 depending on the direction the user is looking to. However, this can be provided for a mobile phone, tablet, laptop etc. The direction the user is looking at is detected using e.g. a head tracker in a head mounted device, or accelerometer/mouse/touchscreen in a mobile phone, tablet, laptop etc. The output signals 32 can be coded/stored/streamed/transmitted to the viewing device.

According to a possibility all processing takes place in the viewing device. The microphone signals as such are coded/stored/streamed/transmitted to the viewing device.

Figure 6:
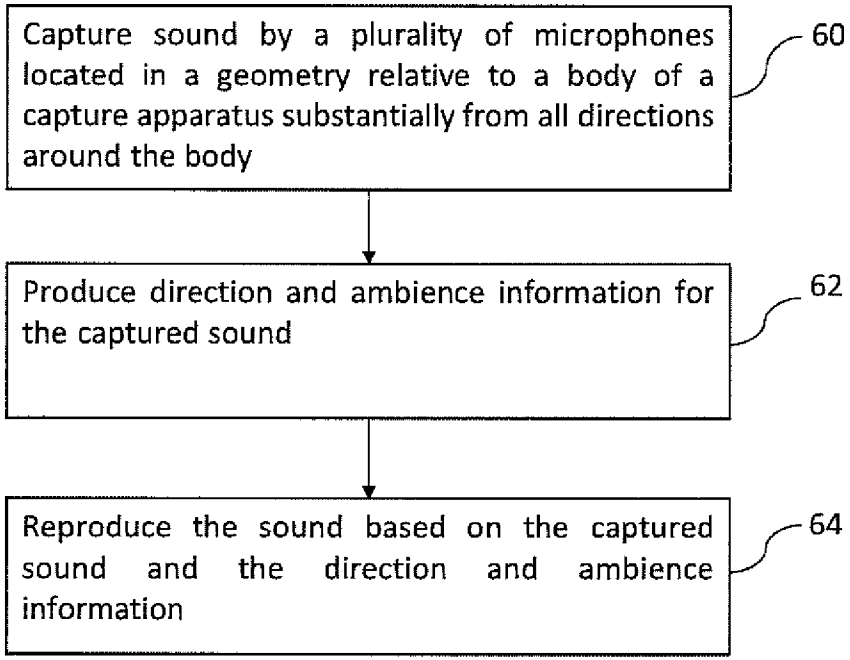
FIG. 6 shows a flow diagram of the operation.

FIG. 6 is a flowchart for a method for capturing sound. In the method sound is captured at 60 by a plurality of microphones located in a predetermined geometry relative to a body of a capture apparatus substantially from all directions around the body. At 62 direction and ambience information is produced for the captured sound. Reproduction of the sound takes then place at 64.

In general, certain operations described above may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof. A computer software executable by a data processor, such as in the processor entity, or by hardware, or by a combination of software and hardware may be provided. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, California and Cadence Design, of San Jose, California automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus comprising a body, a plurality of microphones arranged on the body such that the apparatus is configured to capture sound in a plurality of directions around the body, wherein the plurality of microphones are configured to enable capture of the sound such that a first subset of the plurality of microphones is configured to capture a directional part of the sound around the body, wherein the first subset of the plurality of microphones is configured to receive the sound without acoustic shadowing, wherein all or a second subset of the plurality of microphones is configured to capture at least part of the sound for estimating ambience information of the sound around the body, and electronics for processing first signals from the first subset of the plurality of microphones for the directional part of the sound around the body, and second signals from the all or second subset of the plurality of microphones for the ambience information of the sound around the body.

2. The apparatus of claim 1, wherein the second subset of the plurality of microphones comprises at least one acoustically shadowed microphone with respect to a direction of the directional part of the sound.

3. The apparatus of claim 1, wherein the electronics are further configured to select at least one of:

the first subset of the plurality of microphones to capture the directional part of the sound around the body, or the all or second subset of the plurality of microphones to capture the at least part of the sound for estimating the ambience information of the sound around the body.

4. The apparatus of claim 1, wherein the electronics for processing the first signals from the first subset of the plurality of microphones for the directional part of the sound around the body are configured to perform time and frequency dependent processing of the first signals from the first subset.

5. The apparatus of claim 1, wherein the plurality of microphones are arranged in a predetermined geometry on the body such that the apparatus is configured to capture the sound based on the predetermined geometry.

6. The apparatus of claim 1, wherein the plurality of microphones are configured to enable capture of the sound from any direction around the body such that substantially at least three microphones of the plurality of microphones receive the sound without acoustic shadowing in any direction around the body while at least one other microphone of the plurality of microphones receives the sound with acoustic shadowing relative to a capture direction of the at least three microphones so as to ensure that the sound from the capture direction is captured without acoustic shadowing using the at least three microphones.

7. The apparatus of claim 1, wherein the electronics are configured to determine ambience information of the sound around the body and direction information of at least one sound source within the sound around the body based, at least partially, upon the plurality of microphones.

8. The apparatus of claim 1, wherein the second subset of the plurality of microphones are arranged on the body substantially opposite to the first subset of the plurality of microphones.

9. The apparatus of claim 1, wherein the electronics are configured to:

determine at least one mid signal based, at least partially, on the first signals from the first subset of the plurality of microphones, and determine at least one side signal based, at least partially, on the second signals from the second subset of the plurality of microphones.

10. The apparatus of claim 1, wherein the first subset of the plurality of microphones are configured to receive the sound without acoustic shadowing from the apparatus, wherein the first subset of the plurality of microphones comprises less than all of the plurality of microphones.

11. A method comprising:

capturing sound, with a plurality of microphones arranged on a body of a capture apparatus, in a plurality of directions around the body, wherein the plurality of microphones are configured to enable capture of the sound such that a first subset of the plurality of microphones is configured to capture a directional part of the sound around the body, wherein the first subset of the plurality of microphones is configured to receive the sound without acoustic shadowing, wherein all or a second subset of the plurality of microphones is configured to capture at least part of the sound for estimating ambience information of the sound around the body, and processing first signals from the first subset of the plurality of microphones for the directional part of the sound around the body, and second signals from the all or second subset of the plurality of microphones for the ambience information of the sound around the body.

12. The method of claim 11, wherein the second subset of the plurality of microphones comprises at least one acoustically shadowed microphone with respect to a direction of the directional part of the sound.

13. The method of claim 11, further comprising selecting at least one of:

the first subset of the plurality of microphones to capture the directional part of the sound around the body, or the all or second subset of the plurality of microphones to capture the at least part of the sound for estimating the ambience information of the sound around the body.

14. The method of claim 11, wherein the processing of the first signals from the first subset of the plurality of microphones for the directional part of the sound around the body comprises performing time and frequency dependent processing of the first signals from the first subset.

15. The method of claim 11, wherein the plurality of microphones are configured to enable capture of the sound from any direction around the body such that substantially at least three microphones of the plurality of microphones receive the sound without acoustic shadowing in any direction around the body while at least one other microphone of the plurality of microphones receives the sound with acoustic shadowing relative to a capture direction of the at least three microphones so as to ensure that the sound from the capture direction is captured without acoustic shadowing using the at least three microphones.

16. A non-transitory computer-readable medium comprising program instructions stored thereon which, when executed with at least one processor, cause the at least one processor to:

cause capture of sound, with a plurality of microphones arranged on a body of a capture apparatus, in a plurality of directions around the body, wherein the plurality of microphones are configured to enable capture of the sound such that a first subset of the plurality of microphones is configured to capture a directional part of the sound around the body, wherein the first subset of the plurality of microphones is configured to receive the sound without acoustic shadowing, wherein all or a second subset of the plurality of microphones is configured to capture at least part of the sound for estimating ambience information of the sound around the body, and cause processing of first signals from the first subset of the plurality of microphones for the directional part of the sound around the body, and second signals from the all or second subset of the plurality of microphones for the ambience information of the sound around the body.

17. The non-transitory computer-readable medium of claim 16, wherein the second subset of the plurality of microphones comprises at least one acoustically shadowed microphone with respect to a direction of the directional part of the sound.

18. The non-transitory computer-readable medium of claim 16, wherein the program instructions stored thereon, when executed with the at least one processor, cause the at least one processor to cause selecting of at least one of:

the first subset of the plurality of microphones to capture the directional part of the sound around the body, or the all or second subset of the plurality of microphones to capture the at least part of the sound for estimating the ambience information of the sound around the body.

19. The non-transitory computer-readable medium of claim 16, wherein the processing of the first signals from the first subset of the plurality of microphones for the directional part of the sound around the body comprises causing performance of time and frequency dependent processing of the first signals from the first subset.

20. The non-transitory computer-readable medium of claim 16, wherein the plurality of microphones are configured to enable capture of the sound from any direction around the body such that substantially at least three microphones of the plurality of microphones receive the sound without acoustic shadowing in any direction around the body while at least one other microphone of the plurality of microphones receives the sound with acoustic shadowing relative to a capture direction of the at least three microphones so as to ensure that the sound from the capture direction is captured without acoustic shadowing using the at least three microphones.

* * * * *